US006276405B1

(12) United States Patent
Wang

(10) Patent No.: US 6,276,405 B1
(45) Date of Patent: Aug. 21, 2001

(54) INFLATION NOZZLE PROVIDED WITH MEANS TO ENGAGE AIR VALVES OF DIFFERENT TYPES

(76) Inventor: Lo-Pin Wang, 16F-2, No. 17, Lane 52,Sec. 3,Re He Rd., Taichung (TW)

( * ) Notice: Subject to any disclaimer, the term of this patent is extended or adjusted under 35 U.S.C. 154(b) by 0 days.

(21) Appl. No.: 09/592,945

(22) Filed: Jun. 13, 2000

(51) Int. Cl.[7] ..... B65B 1/04
(52) U.S. Cl. ..... 141/38; 141/383; 152/415
(58) Field of Search ..... 152/415, 427, 152/429; 141/38, 387–389, 383, 384

(56) References Cited

U.S. PATENT DOCUMENTS 4,091,999 * 5/1978 Voos .
5,307,846 * 5/1994 Heinemann ..... 141/1
5,472,031 * 12/1995 Austin ..... 152/415
5,522,910 * 6/1996 Fogal, Sr. ..... 55/505

* cited by examiner

*Primary Examiner*—Steven O. Douglas
(74) *Attorney, Agent, or Firm*—Browdy and Neimark

(57) ABSTRACT

An inflation nozzle has a cylindrical receiving cell which is provided with an air inlet, an open end, and an engagement port for engaging the air valve of an inflatable object. The receiving cell contains a first elastic annular block, a seat block, a second elastic annular block, and a press block. A handle is pivoted to the open end for pressing the press block. The seat block has a through hole in communication with a through hole of the second elastic annular block. The seat block is provided with a rotary member which has a curved portion and a notch. A coil spring enables the curved portion and the notch to remain at an angle at which the curved portion and the notch face the engagement port. When the engagement port is engaged with an air valve of the U.S. specification, the valve tube of the air valve is inserted into the notch to arrest the rotary member such that the valve bar of the air valve is pressed by the curved portion to allow the passage of air. When the engagement port is engaged with an air valve of the French specification, the rotary member is pushed to turn such that the valve bar of the air valve is pressed by the press block to allow the air passage.

9 Claims, 3 Drawing Sheets

INFLATION NOZZLE PROVIDED WITH MEANS TO ENGAGE AIR VALVES OF DIFFERENT TYPES

FIELD OF THE INVENTION

The present invention relates generally to an inflation device, and more particularly to a nozzle of the inflation device, which is provided with means to adjust the nozzle automatically to engage the air valves of different types.

BACKGROUND OF THE INVENTION

The bicycle tires are provided with an air valve of the U.S. type or French type. The conventional bicycle air pump is not compatible with the air valves of both the U.S. type and the French type. However, the modem bicycle air pump comprises a nozzle which is provided with two connection heads engageable with the air valve of the U.S. type and the air valve of the French type. The selection of the connection heads is done manually, thereby discouraging the people to use the modem bicycle air pump as described above.

SUMMARY OF THE INVENTION

The primary objective of the present invention is to provide an inflation device with an inflation nozzle which is compatible with the air valves of the U.S. type and the French type and is easy to use.

In keeping with the principle of the present invention, the foregoing objective of the present invention is attained by the inflation nozzle comprising a housing with a receiving cell which has an open end and an engagement port. The receiving cell contains a first elastic annular block which is provided with a through hole opposite to the engagement port. A seat block is movably disposed in the receiving cell such that the seat block urges the first elastic annular block. The seat block is provided with a through hole opposite to the through hole of the first elastic annular block, and a space in which a rotary member is pivoted. The rotary member has a main portion, a curved portion extending from the main portion, and a notch formed between the main portion and the curved portion. The main portion is provided with a retaining portion for retaining the seat block at an angle at such time when the rotary member turns in the direction toward the opening of the notch. The curved portion and the notch face the engagement port such that one end of the curved portion is substantially located on the center line of the through hole of the first elastic annular block. The rotary member is guided by a recovery elastic member which is disposed between the seat block and the rotary member. The receiving cell is further provided with a second elastic annular block which is provided with a through hole opposite to the through hole of the seat block and smaller in diameter than the through hole of the first elastic annular block. The open end of the receiving cell is provided with a press block capable of moving along the longitudinal direction of the receiving cell and having an air guiding hole extending from the outer periphery of the press block to a portion which is corresponding in location to the through hole of the second elastic annular block. A handle is fastened pivotally to the housing in such a manner that the handle is corresponding in location to the open end of the receiving cell so as to push the press block to press against the seat block.

DETAILED DESCRIPTION OF THE INVENTION

Figure 1:
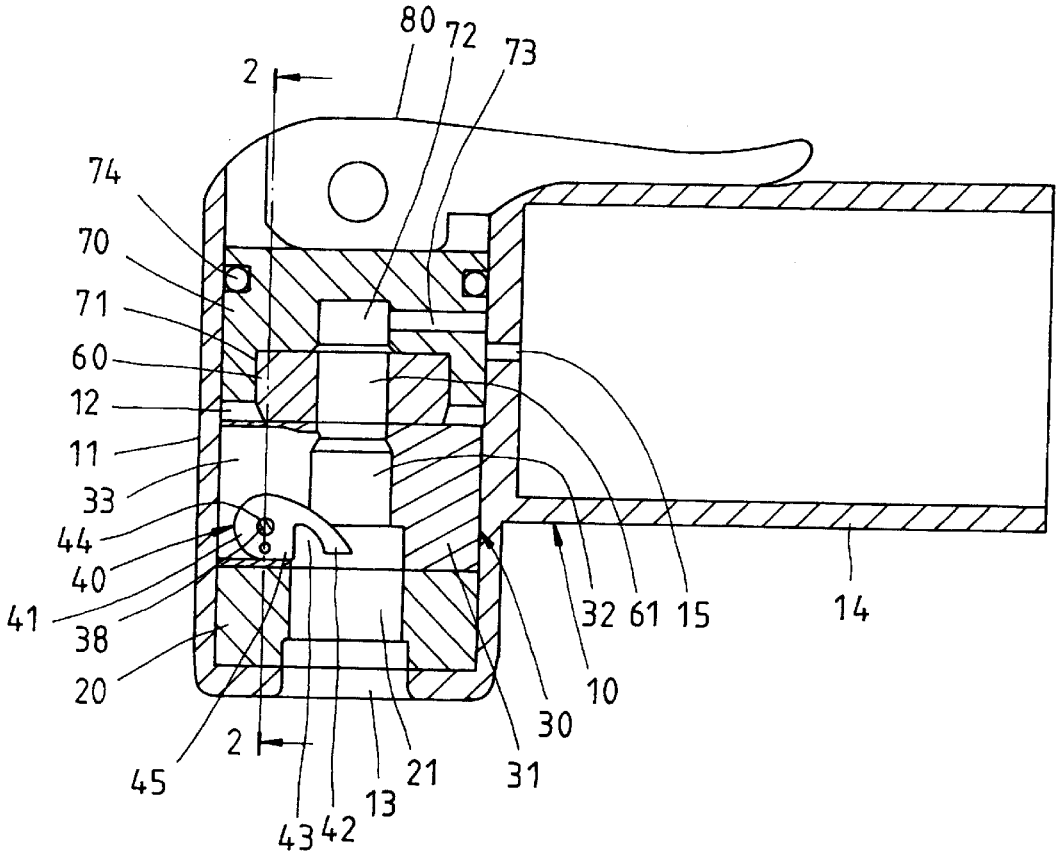
FIG. 1 shows a side sectional view of a preferred embodiment of the present invention.
Figure 2:
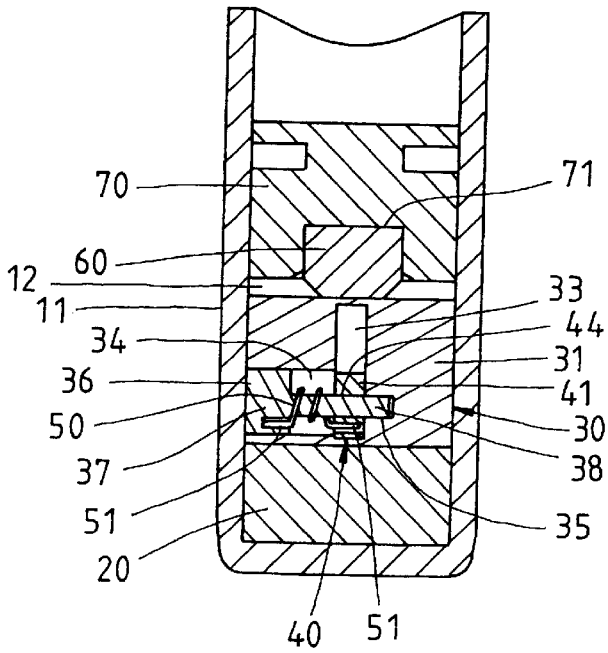
FIG. 2 shows a sectional view taken along the direction indicated by a line 2—2 as shown in FIG. 1.

As shown in FIGS. 1 and 2, an inflation nozzle of the preferred embodiment of the present invention comprises the component parts which are described hereinafter. The inflation nozzle is designed for use with a hand-held inflation device.

A housing 10 has a cylindrical body 11 which is provided in the interior with a receiving cell 12. The receiving cell 12 is provided with an open top end, and in the bottom end thereof with an engagement port 13 in communication with the atmospheric air. The cylindrical body 11 is provided with a tubular body 14 fastened therewith for connecting the inflation nozzle of the present invention with a cylinder 91 of the handheld inflation device (not shown in the drawings). The tubular body 14 may be also connected by a hose with a floor air pump and the like. The housing 10 is provided with an air inlet 15 in communication with the receiving cell 12.

A first elastic annular block 20 is made of a rubber material and is disposed at the bottom end of the receiving cell 12. The first elastic annular block 20 is provided in the center with a through hole 21 opposite to the engagement port 13 and corresponding in diameter to the air valve of the U.S. type.

A seat block 30 is formed of a primary member 31 and a secondary member 36. The primary member 31 is of a cylindrical construction and is slidably disposed in the cylindrical receiving cell 12 such that the bottom end of the primary member 31 urges the first elastic annular block 20. The primary member 31 is provided with an axial through hole 32 opposite to the through hole 21 of the first elastic annular block 20. The seat block 30 is further provided with a space 33 extending radially from one side of the wall of the axial through hole 32. One of two side walls of the space 33 is provided with a cavity 34, whereas other one of the two side walls of the space 33 is provided with a rod hole 35 opposite to the cavity 34. The secondary member 36 is provided with a block-shaped portion 37 and is received in the cavity 34 such that the block-shaped portion 37 is lodged in the outer end of the cavity 34. The secondary member 36 is further provided with a rod-shaped portion 38 extending from the block-shaped portion 37 to insert into the rod hole 35.

A rotary member 40 is of a platelike construction and is held in the space 33. The rotary member 40 is formed of a main portion 41, a curved portion 42 extending from the main portion 41, and a notch 43 formed between the main portion 41 and the curved portion 42. The main portion 41 is provided with an axial hole 44 by means of which the rotary member 40 is pivoted to the rod-shaped portion 38. The main portion 41 is further provided with a retaining portion 45, which serves to retain the underside of the space 33 at such time when the rotary member 40 turns clockwise along the notch 43. As a result, the curved portion 42 and the notch 43 face the engagement port 13. In the meantime, the end of the curved portion 42 is substantially located at the center of the through hole 32, whereas one side edge of the notch 43 is flush with the wall of the through hole 21 of the first elastic annular block 20.

A recovery elastic member 50 of the preferred embodiment of the present invention is a coil spring, which is fitted over the rod-shaped portion 38 of the secondary member 36. The coil spring 50 is provided at both ends with an axial section 51, which is inserted into the block-shaped portion 37 of the secondary member 36 and the main portion 41 of the rotary member 40, thereby enabling the rotary member 40 to remain in a state as shown in FIG. 1. When the rotary member 40 is exerted on by an external force, the rotary member 40 is forced to turn counterclockwise. As soon as the rotary member 40 is relieved of the external force, the recovery force of the coil spring 50 forces the rotary member 40 to turn clockwise to return to remain at the original state as shown in FIG. 1.

A second elastic annular block 60 is made of a rubber material and is stacked on the seat block 30. The second elastic annular block 60 is smaller in outer diameter than the seat block 30 and is provided with a central through hole 61 opposite to the through hole 32 of the seat block 30 and corresponding in diameter to an air valve of the French type. The through hole 61 is smaller in diameter than the through hole 21 of the first elastic annular block 20.

A press block 70 is of a cylindrical construction and is slidably disposed in the top end of the receiving cell 12 such that a slot 71 of the bottom of the press block 70 is fitted over the second elastic annular block 60. The slot 71 is provided in the center of the bottom thereof with a cavity 72 corresponding in location to the through hole 61 of the second elastic annular block 60. The press block 70 is provided with an air guiding hole 73 extending from the outer surface of the press block 70 to be in communication with the cavity 72. The press block 70 is provided with a leakproof ring 74 fitted thereover.

Figure 4:
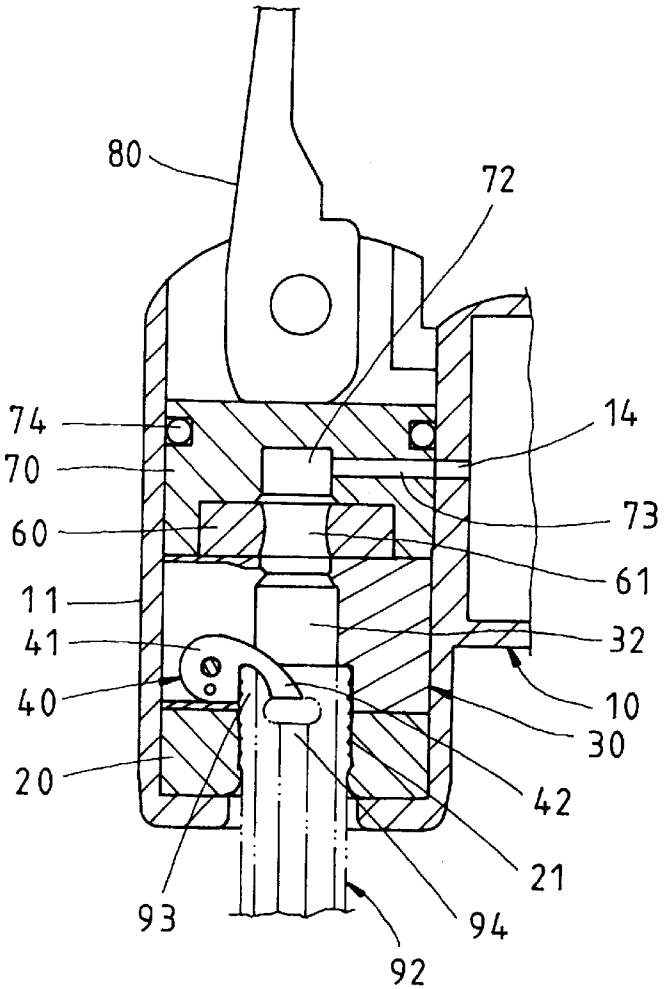
FIGS. 3 and 4 are side sectional views of the preferred embodiment of the present invention at work with an air valve of the U.S. type.

A handle 80 is fastened pivotally to the top end of the cylindrical body 11 of the housing 10 such that the handle 80 can be swiveled between a standby position, as shown in FIG. 1, and an operating position, as shown in FIG. 4. When the handle 80 is located at the operating position, the handle 80 forces the press block 70 to move downward to press against the seat block 30.

As shown in FIG. 1, the inflation nozzle of the present invention is in the standby position such that the seat block 30 and the press block 70 are pushed by the first and the second elastic annular blocks 20 and 60 to remain at the upper stop point, and that the rotary member 40 remains at the original state.

Figure 3:
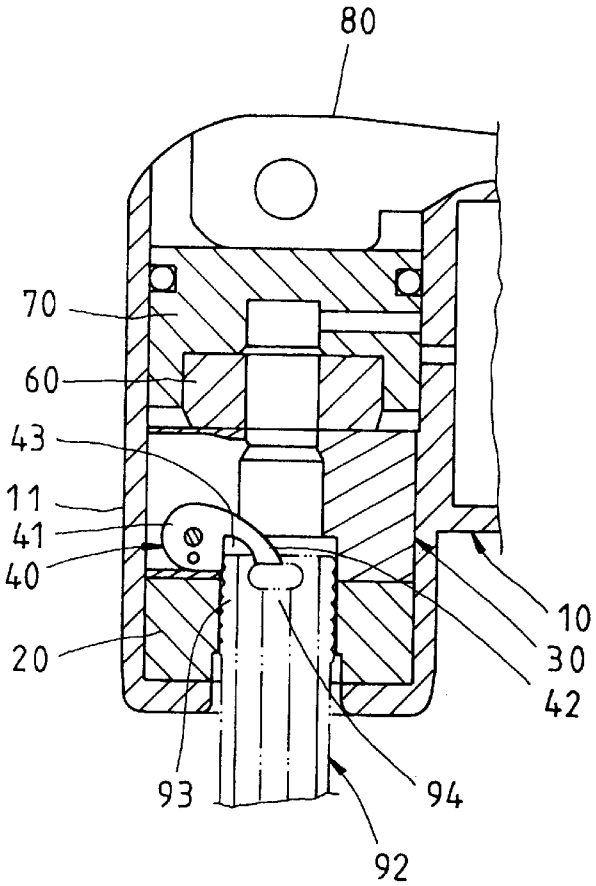

As shown in FIGS. 3 and 4, the engagement port 13 of the present invention is engaged with an air valve 92 of the U.S. type such that the air valve 92 penetrates the first elastic annular block 20, and that one side of the front end of a valve tube 93 of the air valve 92 is received in the notch 43 of the rotary member 40, and further that a valve bar 94 of the air valve 92 comes in contact with one end of the curved portion 42 of the rotary member 40. In light of the main portion 41 of the rotary member 40 being stopped by the valve tube 93, the rotary member 40 can not be pushed to turn. The valve bar 94 of the air valve 92 is pressed against by the curved portion 42 of the rotary member 40, thereby opening up the air valve 92. When the handle 80 is swiveled to the operating position as shown in FIG. 4, the press block 70 is forced to move downward to press against the seat block 30, which in turn presses against the first elastic annular block 20 to deform such that the wall of the through hole 21 of the first elastic annular block 20 holds securely the air valve 92. As a result, air is pumped into the receiving cell 12 via the air inlet 15, and then into the cavity 72 via the air guiding hole 73 of the press block 70, and finally into the air valve 92 via the second elastic annular block 60 and the through hole 32 of the seat block 30.

Figure 6:
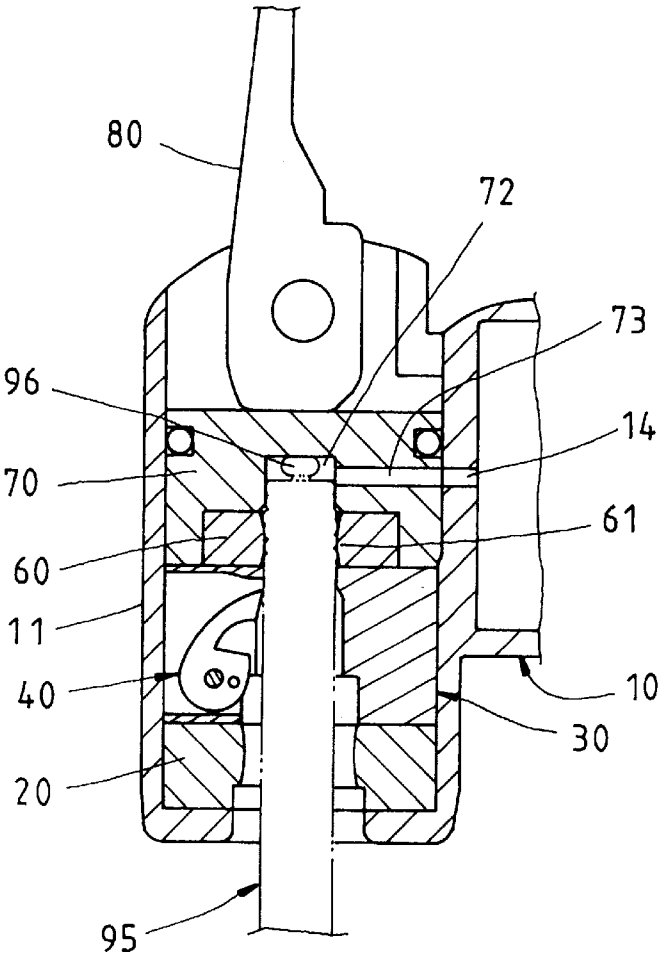
FIGS. 5 and 6 are side sectional views of the preferred embodiment of the present invention at work with an air valve of the French type.
Figure 5:
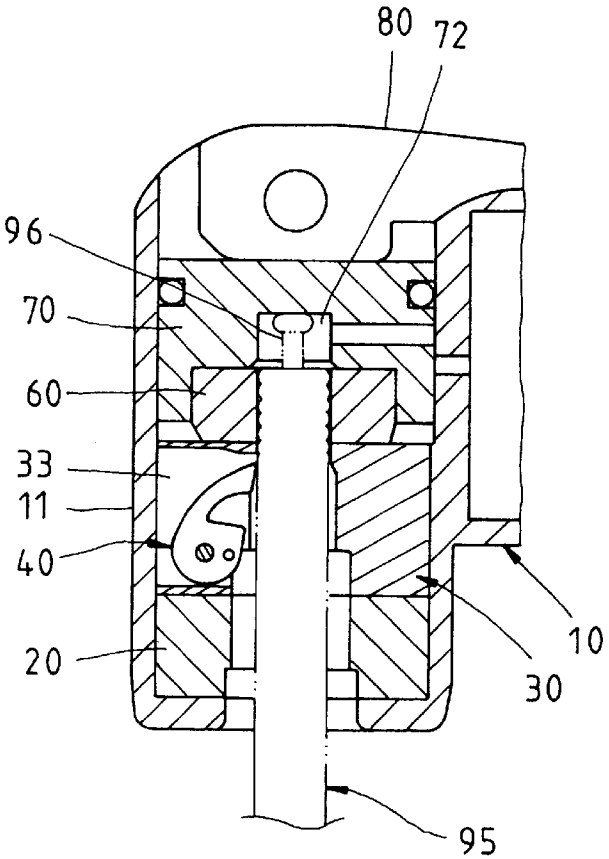

As shown in FIG. 5, the inflation nozzle of the present invention is engaged with an air valve 95 of the French type such that the curved portion 42 of the rotary member 40 is pushed by the air valve 95, thereby causing the rotary member 40 to turn counterclockwise. In the meantime, the curved portion 42 of the rotary member 40 moves from the center of the through hole 32 into the space 33 so as to allow the air valve 95 to advance further until such time when the front end of the air valve 95 is located in the cavity 72 of the press block 70. When the handle 80 is swiveled to the operating position as shown in FIG. 6, the second elastic annular block 60 is so deformed that the inner wall of the through hole 61 holds securely the air valve 95. In the meantime, the valve bar 96 is pressed against by the press block 70 to open up the air valve 95 into which the air enters from the cavity 72.

Upon completion of inflating an inflatable object, the handle 80 is swiveled back to the standby position. The inflation nozzle of the present invention is disengaged with the air valve of the inflatable object. As a result, the first and the second elastic annular blocks 20 and 60 regain their original forms and then push the seat block 30 and the press block 70 back to their original positions. The rotary member 40 is forced by the recovery force of the coil spring 50 to return to its original state as shown in FIG. 1.

What is claimed is:

1. An inflation nozzle of an inflation device, said inflation nozzle comprising:

a housing with a receiving cell, said receiving cell having an open end and an engagement port opposite in location to said open end, said receiving cell provided in a wall with an air inlet;

a first elastic annular block disposed in said receiving cell such that said first elastic annular block is corresponding in location to said engagement port, said first elastic annular block provided with a through hole opposite to said engagement port whereby said through hole is dimensioned to receive an air valve of an inflatable object;

a seat block slidably disposed in said receiving cell such that said seat block urges said first elastic annular block, and that said seat block slides along a longitudinal direction of said receiving cell, said seat block provided with a through hole opposite to said through hole of said first elastic annular block, said seat block further provided with a space located at one side of said through hole of said seat block;

a rotary member pivoted in said space and formed of a main portion, a curved portion extending from said main portion, and a notch formed between said main portion and said curved portion, said main portion provided with a retaining portion to retain said seat block at such time when said rotary member turns to remain in a standby state in which said curved portion and said notch face said engagement port such that one end of said curved portion is located on a center line of said through hole of said first elastic annular block;

a recovery elastic member disposed between said seat block and said rotary member for providing a spring force to enable said rotary member to turn along said notch;

a second elastic annular block disposed in said receiving cell such that said second elastic annular block urges said seat block, said second elastic annular block provided with a through hole opposite to said through hole of said seat block and smaller in hole diameter than said through hole of said first elastic annular block;

a press block slidably disposed in said open end of said receiving cell such that said press block urges said second elastic annular block, and that said press block slides along the longitudinal direction of said receiving cell, said press block provided with an air guiding hole; and a handle pivoted to said housing such that said handle is corresponding in location to said open end of said receiving cell, and that said handle presses against said press block.

2. The inflation nozzle as defined in claim 1, wherein one side of said notch is flush with a wall of said through hole of said first elastic annular block at the time when said retaining portion of said main portion of said rotary member is stopped by said seat block.

3. The inflation nozzle as defined in claim 1, wherein said seat block is formed of a primary member and a secondary member, said primary member provided with a through hole, a space, and a cavity, said secondary member provided with a block-shaped portion and a rod-shaped portion extending from said block-shaped portion, said block-shaped portion being lodged in an outer end of said cavity, said rod-shaped portion being extended into said space; wherein said main portion of said rotary member is provided with an axial hole for pivoting with said rod-shaped portion of said secondary member; wherein said recovery elastic member is fitted over said rod-shaped portion of said secondary member such that one end of said recovery elastic member is fitted into said block-shaped portion of said secondary member, and that other end of said recovery elastic member is fitted into said main portion of said rotary member.

4. The inflation nozzle as defined in claim 3, wherein said space is provided with a rod hole opposite to one side of said cavity; wherein one end of said rod-shaped portion of said secondary member is inserted into said rod hole.

5. The inflation nozzle as defined in claim 1, wherein said press block is provided with a cavity opposite to said through hole of said second elastic annular block; wherein said air guiding hole is in communication with said cavity of said press block.

6. The inflation nozzle as defined in claim 5, wherein said press block is provided with a slot to fit over said second elastic annular block; wherein said cavity is located in an underside of said slot.

7. The inflation nozzle as defined in claim 1, wherein said press block is provided with a leakproof ring fitted thereover such that said leakproof ring is located in proximity of said open end of said receiving cell; wherein said first elastic annular block has an outer surface in contact with the wall of said receiving cell; wherein said air inlet is located between said leakproof ring and said first elastic annular block.

8. The inflation nozzle as defined in claim 1, wherein said through hole of said first elastic annular block has a hole diameter corresponding to the outer diameter of the air valve of the U.S. type; wherein said through hole of said second elastic annular block has a hole diameter corresponding to the outer diameter of the air valve of the French type.

9. The inflation nozzle as defined in claim 1, wherein said housing is provided with a tubular body whereby said tubular body is engaged with a cylinder of the inflation device.

* * * * *